US008319688B2

(12) United States Patent
Parsche

(10) Patent No.: US 8,319,688 B2
(45) **Date of Patent: *Nov. 27, 2012**

(54) PLANAR SLOT ANTENNA HAVING MULTI-POLARIZATION CAPABILITY AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 454 days.

This patent is subject to a terminal disclaimer.

(21) Appl. No.: 12/388,004

(22) Filed: Feb. 18, 2009

(65) Prior Publication Data

US 2010/0207829 A1 Aug. 19, 2010

(51) Int. Cl.
*H01Q 1/38* (2006.01)

(52) U.S. Cl. ..... 343/700 MS; 343/767

(58) Field of Classification Search ..... 343/767, 343/770, 700 MS

See application file for complete search history.

(56) References Cited

U.S. PATENT DOCUMENTS

| | | | | | |
|---|---|---|---|---|---|
| 1,892,221 | A | | 12/1932 | Runge | 343/853 |
| 2,507,528 | A | * | 5/1950 | Kandoian | 343/767 |
| 2,615,134 | A | | 10/1952 | Carter | 250/33.67 |
| 2,791,769 | A | | 5/1957 | Lindenblad | 343/770 |
| 3,474,452 | A | | 10/1969 | Bogner | 343/726 |
| 4,160,978 | A | | 7/1979 | DuHamel | 343/742 |
| 4,208,660 | A | * | 6/1980 | McOwen, Jr. | 343/769 |
| 4,588,993 | A | | 5/1986 | Babij et al. | 343/351 |
| 5,061,943 | A | * | 10/1991 | Rammos | 343/770 |
| 5,675,346 | A | | 10/1997 | Nishikawa et al. | 343/700 |
| 5,691,731 | A | | 11/1997 | Van Erven | 343/742 |
| 5,714,961 | A | * | 2/1998 | Kot et al. | 343/769 |
| 5,769,879 | A | | 6/1998 | Richards et al. | 607/101 |
| 5,838,283 | A | | 11/1998 | Nakano | 343/741 |
| 5,977,921 | A | | 11/1999 | Niccolai et al. | 343/741 |

(Continued)

FOREIGN PATENT DOCUMENTS

EP 0516303 12/1992

OTHER PUBLICATIONS

Nikolaou, Symeon, et. al., Pattern and Frequency Reconfigurable Annular Slot Antenna Using PIN Diodes, Feb. 2006, IEEE Trans. on Antennas and Propagation, vol. 54, No. 2, pp. 439-448.*

(Continued)

*Primary Examiner* — Hoanganh Le

(74) *Attorney, Agent, or Firm* — Allen, Dyer, Doppelt, Milbrath & Gilchrist, P.A.

(57) ABSTRACT

The antenna apparatus may include a planar, electrically conductive, slot antenna element having a geometrically shaped opening therein defining an inner perimeter, and a pair of spaced apart signal feedpoints along the inner perimeter separated by a distance of one quarter of the inner perimeter to impart a traveling wave current distribution. The inner perimeter of the planar, electrically conductive, slot antenna element may be equal to about one operating wavelength thereof. The antenna apparatus may provide at least one of linear, circular, dual linear and dual circular polarizations, and it may provide an in situ or conformal antenna for vehicles or aircraft.

25 Claims, 7 Drawing Sheets

U.S. PATENT DOCUMENTS

| | | | | |
|---|---|---|---|---|
| 6,208,903 | B1 | 3/2001 | Richards et al. | 607/101 |
| 6,215,402 | B1 | 4/2001 | Rao Kodukula et al. | 340/572.8 |
| 6,522,302 | B1 | 2/2003 | Iwasaki | 343/726 |
| 7,027,001 | B2 | 4/2006 | Thudor et al. | 343/769 |
| 7,088,298 | B1 | 8/2006 | Chan | 343/727 |
| 2002/0050828 | A1 | 5/2002 | Seward, IV et al. | 324/652 |
| 2005/0110689 | A1 | 5/2005 | Masutani | 343/700 |
| 2008/0136720 | A1 | 6/2008 | Parsche et al. | 343/741 |
| 2008/0150819 | A1 | 6/2008 | Uno et al. | 343/770 |
| 2008/0266178 | A1* | 10/2008 | Tiezzi et al. | 343/700 MS |
| 2010/0073242 | A1* | 3/2010 | Ayala Vazquez et al. | 343/702 |

OTHER PUBLICATIONS

"Wideband Probe-Fed Circularly Polarised Circular Loop Antenna", Laskar et al., 2 pages, Electronics Letters, vol. 41, No. 18, Sep. 1, 2005.

"A Monopole-Fed Circularly Polarized Loop Antenna", Ojiro et al, pp. 810-813, 1998 IEEE.

"Intermediate-Sized Loop Antennas", Jefferies, pp. 1-15, Apr. 27, 2004, available at www.ee.surrey.ac.uk/Personal/D.Jefferies/loop.html.

* cited by examiner

PLANAR SLOT ANTENNA HAVING MULTI-POLARIZATION CAPABILITY AND ASSOCIATED METHODS

FIELD OF THE INVENTION

The present invention relates to the field of communications, and, more particularly, to antennas and related methods.

BACKGROUND OF THE INVENTION

Antennas may include transducers for electromagnetic waves and electric currents and the various shapes may have three complimentary forms: slot, panel and skeleton. For instance, the skeleton form of the circle antenna may include a circular wire loop, the complimentary panel structure may include a circular metal disc, and the slot structure may include a circular hole in a metal sheet. The various compliments are beneficial for different applications, such as realizing antennas of low wind resistance, antennas for an aluminum aircraft fuselage, or e.g. for metal stamping.

It is possible to have dual linear or dual circular polarization channel diversity. That is, a frequency may be reused if one channel is vertically polarized and the other horizontally polarized. Or, a frequency can also be reused if one channel uses right hand circular polarization (RHCP) and the other left hand circular polarization (LHCP). Polarization refers to the orientation of the E field in the radiated wave, and if the E field vector rotates in time, the wave is then said to be rotationally or circularly polarized.

Today, the antenna may be the only piece of associated equipment that remains to be miniaturized for use in various environments. Conformal antennas can be formed in situ from conductive surfaces, providing an antenna function without added size. For instance, a slot can be an antenna in the metallic structure of an aircraft without increasing the size of the aircraft or increasing drag. Although many slot antennas may be linear, e.g. a straight line in shape, the circular slot antenna may be advantaged: as the circle provides the greatest area for the smallest perimeter, it may provide the largest antenna aperture for the least circumference.

An electromagnetic wave (and radio wave, specifically) has an electric field that varies as a sine wave within a plane coincident with the line of propagation, and the same is true for the magnetic field. The electric and magnetic planes are perpendicular and their intersection is in the line of propagation of the wave. If the electric-field plane does not rotate (about the line of propagation) then the polarization is linear. If, as a function of time, the electric field plane (and therefore the magnetic field plane) rotates, then the polarization is rotational. Rotational polarization is in general elliptical, and if the rotation rate is constant at one complete cycle every wavelength, then the polarization is circular. The polarization of a transmitted radio wave is determined in general by the structure of the transmitting antenna, the orientation of the antenna, and the current distribution thereupon For example, the monopole antenna and the dipole antenna are two common examples of antennas with linear polarization. An axial mode helix antenna is a common example of an antenna with circular polarization, and another example is a crossed array of dipoles fed in quadrature. Linear polarization is usually further characterized as either vertical or horizontal. Circular Polarization is usually further classified as either Right Hand or Left Hand.

The dipole antenna has been perhaps the most widely used of all the antenna types. It is of course possible however to radiate from a conductor which is not constructed in a straight line. Preferred antenna shapes are often Euclidian, being simple geometric shapes known through the ages. In general, antennas may be classified as to divergence or curl of electric currents, corresponding to dipoles and loops, and line and circle structures.

Many structures are described as loop antennas, but standard accepted loop antennas are a circle. The resonant loop is a full wave circumference circular conductor, often called a "full wave loop". The typical prior art full wave loop is linearly polarized, having a radiation pattern that is a two petal rose, with two opposed lobes normal to the loop plane, and a gain of about 3.6 dBi. Reflectors are often used with the full wave loop antenna to obtain a unidirectional pattern.

Dual linear polarization (simultaneous vertical and horizontal polarization from the same antenna) has commonly been obtained from crossed dipole antennas. For instance, U.S. Pat. No. 1,892,221, to Runge, proposes a crossed dipole system. A dual polarized loop antenna could be more desirable however, as loops provide greater gain in smaller area.

A slot form turnstile antenna is described in "A Shallow-Cavity UHF Crossed-Slot Antenna", by C. A. Lindberg, Institute For Electrical and Electronics Engineers (IEEE) Transactions on Antennas and Propagation, Vol. AP-17, No. 5, September 1969. According to Lindberg, two dipoles are realized in sheet metal as crossed slots. The inside corners comprise 4 terminals that form 2 ports in a phase quadrature feed, e.g. 0, 90, 270, and 360 degrees at the terminals and 0, 90 degrees across the slots. Crossing dipoles and slot dipoles may be common for circular polarization, yet circular rather than X shapes may be advantaged for smaller size and greater directivity.

U.S. Pat. No. 5,977,921 to Niccolai, et al. and entitled "Circular-polarized Two-way Antenna" is directed to an antenna for transmitting and receiving circularly polarized electromagnetic radiation which is configurable to either right-hand or left-hand circular polarization. The antenna has a conductive ground plane and a circular closed conductive loop spaced from the plane, i.e., no discontinuities exist in the circular loop structure. A signal transmission line is electrically coupled to the loop at a first point and a probe is electrically coupled to the loop at a spaced-apart second point. This antenna requires a ground plane and includes a parallel feed structure, such that the RF potentials are applied between the loop and the ground plane. The "loop" and the ground plane are actually dipole half elements to each other.

U.S. Pat. No. 5,838,283 to Nakano and entitled "Loop Antenna for Radiating Circularly Polarized Waves" is directed to a loop antenna for a circularly polarized wave. Driving power fed may be conveyed to a feeding point via an internal coaxial line and a feeder conductor passes through an I-shaped conductor to a C-type loop element disposed in spaced facing relation to a ground plane. By the action of a cutoff part formed on the C-type loop element, the C-type loop element radiates a circularly polarized wave. Dual linear or dual circular polarization are not however provided.

U.S. Published Patent Application No. 2008 0136720 entitled "Multiple Polarization Loop Antenna And Associated Methods" to Parsche et al. includes methods for circular polarization in thin wire loop antennas. A full wave circumference loop is fed in phase quadrature (0°, 90°) using two driving points.

However, there is still a need for a relatively small planar and/or conformal slot antenna for operation with any polarization including linear, circular, dual linear and dual circular polarizations.

SUMMARY OF THE INVENTION

In view of the foregoing background, it is therefore an object of the present invention to provide a planar slot antenna having versatile polarization capabilities, such as linear, circular, dual linear and dual circular polarization capabilities, for example.

This and other objects, features, and advantages in accordance with the present invention are provided by a planar antenna apparatus including a planar, electrically conductive, slot antenna element having a geometrically shaped opening therein defining an inner perimeter, and a pair of spaced apart signal feedpoints along the inner perimeter of the planar, electrically conductive, slot antenna element and separated by a distance of one quarter of the inner perimeter to impart a traveling wave current distribution. The inner perimeter of the planar, electrically conductive, slot antenna element may be equal to about one operating wavelength thereof. Such a relatively small and inexpensive antenna device has versatile polarization capabilities and includes enhanced gain for the size.

A feed structure may be coupled to the signal feedpoints to drive the planar, electrically conductive, slot antenna element with a phase input to provide at least one of linear, circular, dual linear and dual circular polarizations. The planar, electrically conductive, slot antenna element may be devoid of a ground plane adjacent thereto, and the geometric shape of the opening of the planar, electrically conductive, slot antenna element may be a circle or a polygon.

Each of the signal feedpoints may define a discontinuity in the planar, electrically conductive, slot antenna element. Each of the signal feedpoints may be a notch in the planar, electrically conductive, slot antenna element. Each of the notches may open inwardly to the inner perimeter and may extend outwardly from the inner perimeter toward an outer perimeter of the planar, electrically conductive, slot antenna element. Each of the notches may extend outwardly and perpendicular from a respective tangent line of the inner perimeter.

A method aspect is directed to method of making a planar antenna apparatus including providing a planar, electrically conductive, slot antenna element having a geometrically shaped opening therein defining an inner perimeter, and forming a pair of spaced apart signal feedpoints along the inner perimeter of the planar, electrically conductive, slot antenna element and separated by a distance of one quarter of the inner perimeter to impart a traveling wave current distribution. The inner perimeter of the planar, electrically conductive, slot antenna element may be equal to about one operating wavelength thereof. The method may include coupling a feed structure to the signal feedpoints to drive the planar, electrically conductive, slot antenna element with a phase input to provide at least one of linear, circular, dual linear and dual circular polarizations.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
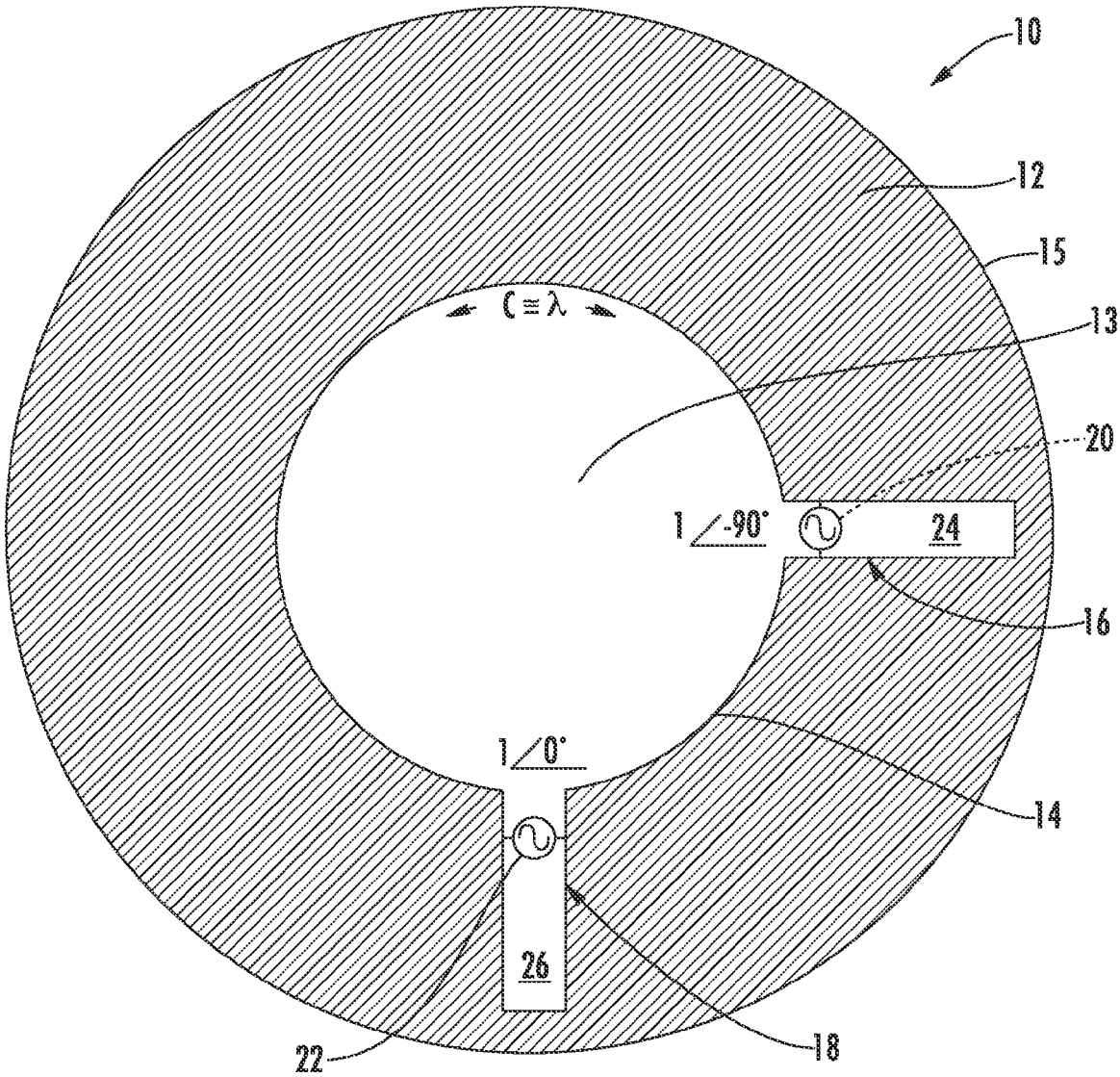
FIG. 1 is a schematic diagram illustrating an embodiment of a planar slot antenna apparatus according to the present invention.

Referring initially to FIG. 1, an embodiment of an antenna apparatus 10 with linear, circular, dual linear and dual circular polarization capabilities will be described. The antenna apparatus 10 may be substantially flat and conformal, e.g. for use in a surface such as the roof of a vehicle, and may be relatively small with the most gain for the size. The antenna apparatus 10 may be used for personal communications such as mobile telephones, and/or satellite communications such as GPS navigation and Satellite Digital Audio Radio Service (SDARS), for example.

The planar antenna apparatus 10 includes a slot antenna element 12 having a geometrically shaped opening 13 therein defining an inner perimeter 14. The slot antenna element 12 may be formed as a conductive layer on a printed wiring board (PWB) or from a stamped metal sheet such as 0.010" brass, for example. In the embodiment illustrated, the shape of the opening 13 in the planar, electrically conductive, slot antenna element 12 is circular, and the inner perimeter 14 is the inner circular circumference. The diameter of opening 13 may be 0.331 wavelengths such that the inner circumference is 1.04 wavelengths. So at 1000 MHz for example, the opening 13 diameter may be 12.3 inches and the inner circumference therefore $12.3/\pi=3.91$ inches.

The planar antenna apparatus 10 is not so limited as to require that slot antenna element 12 be planar and circular. Slot antenna element 12 may for instance be comprised of the sheet metal of an aircraft fuselage and assuming the shape and curvature of the airframe. Thus, the planar antenna apparatus 10 may be an in situ antenna with slot antenna element 12 being formed in place in a conductive housing, metal wall, vehicle body, etc.

A pair of spaced apart signal feedpoints 16, 18 are along the inner perimeter 14 of the planar, electrically conductive, slot antenna element 12 and separated by a distance of one quarter of the inner perimeter. Illustratively in FIG. 1, signal sources 20, 22 are shown as being connected at the signal feedpoints 16, 18.

As a circular opening 13 in the planar, electrically conductive, slot antenna element 12, the separation distance of the signal feedpoints 16, 18 is about 90 degrees along the circumference. The separation of the signal feedpoints 16, 18 allows a feed structure to impart a traveling wave current distribution in the planar, electrically conductive, slot antenna element 12, as discussed in further detail below. The inner perimeter 14 of the planar, electrically conductive, slot antenna element 12 is equal to about one operating wavelength thereof.

Figure 2:
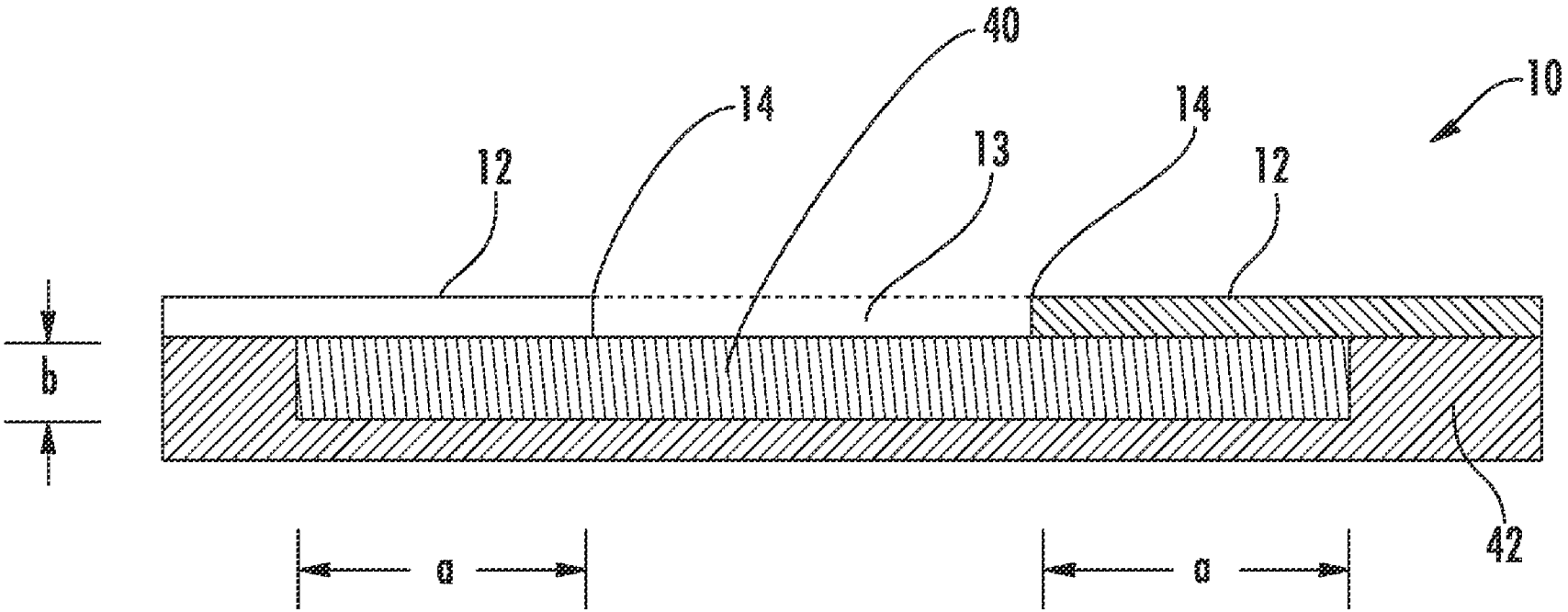
FIG. 2 is a cross-sectional view of the planar slot antenna apparatus of FIG. 1 and including a backing cavity.

Referring to FIG. 2, a cross-sectional or profile view of the FIG. 1 embodiment is shown and includes a backing cavity 40. The cavity 40 may optionally be formed on one side of slot antenna element 12 for unidirectional radiation and reception, and cavity 40 may be filled with air or a nonconductive material such as polystyrene foam. The cavity 40 is defined by a conductive cavity wall 42, which may be aluminum or brass. Opening 13 may be air or contain a nonconductive fill such as polystyrene or polystyrene foam. The cavity depth, denoted by the reference character b in FIG. 2, may be electrically thin, e.g. 1/20 wavelengths or 0.59 inches at 1000 MHz. The microstrip dimension of the cavity, denoted by reference character a, may be ¼ wavelengths or 2.95 inches in air at 1000 MHz. The cavity depicted is of the transverse electromagnetic (TEM) mode although the present invention is not so limited however as to require a specific cavity mode or even a cavity at all. Such a relatively small and inexpensive antenna apparatus 10 has versatile radiation capabilities, multiple polarization capabilities, and includes enhanced gain for the size.

Referring to FIG. 1, each of the signal feedpoints 16, 18 illustratively comprises a notch 24, 26 in the planar, electrically conductive, slot antenna element 12. Each of the notches 24, 26 opens inwardly to the inner perimeter 14, and each of the notches extends outwardly (e.g. ¼ wavelength in the example) from the inner perimeter toward an outer perimeter 15 of the planar, electrically conductive, slot antenna element 12. In FIG. 1 for simplicity, each of the notches 24, 26 illustratively extends radially outward and perpendicular to a respective tangent line of the inner perimeter 14.

Referring additionally to FIG. 1, the slot antenna element 12 may be driven with phase and amplitude inputs to provide at least one of linear, circular, dual linear and dual circular polarizations. When signal sources 20, 22 are equal amplitude and equal phase, e.g. 1 volt at 0 degrees and 1 volt at 0 degrees respectively, dual linear polarization results as the vertical component of the wave is referred by signal source 22 and the horizontal component is referred by signal source 20. Note that signal feedpoints 16, 18 are electrically isolated from one another and signal sources 20, 22 may multiplex different communications on the same frequency, providing polarization diversity, etc. In prototypes of the present invention, 20 to 30 dB of isolation has been measured between signal feedpoints 16, 18. Slot antenna element 12 is of course a reciprocal device which provides transmission and reception at the same configured polarization.

Further referring to FIG. 1, right hand circular polarization is rendered upwards out of the page from the slot antenna element 12 when signal source 20 is 1 volt at −90 degrees and signal source 22 is 1 volt at 0 degrees phase, for example. Conversely, left hand circular polarization is rendered upwards out of the page from the slot antenna element 12 when signal source 20 is 1 volt at +90 degrees and signal source 22 is 1 volt at 0 degrees phase. The circular polarization may be single circular or dual circular depending on the external feed structure used to divide the power and phase the excitations.

Figure 3:
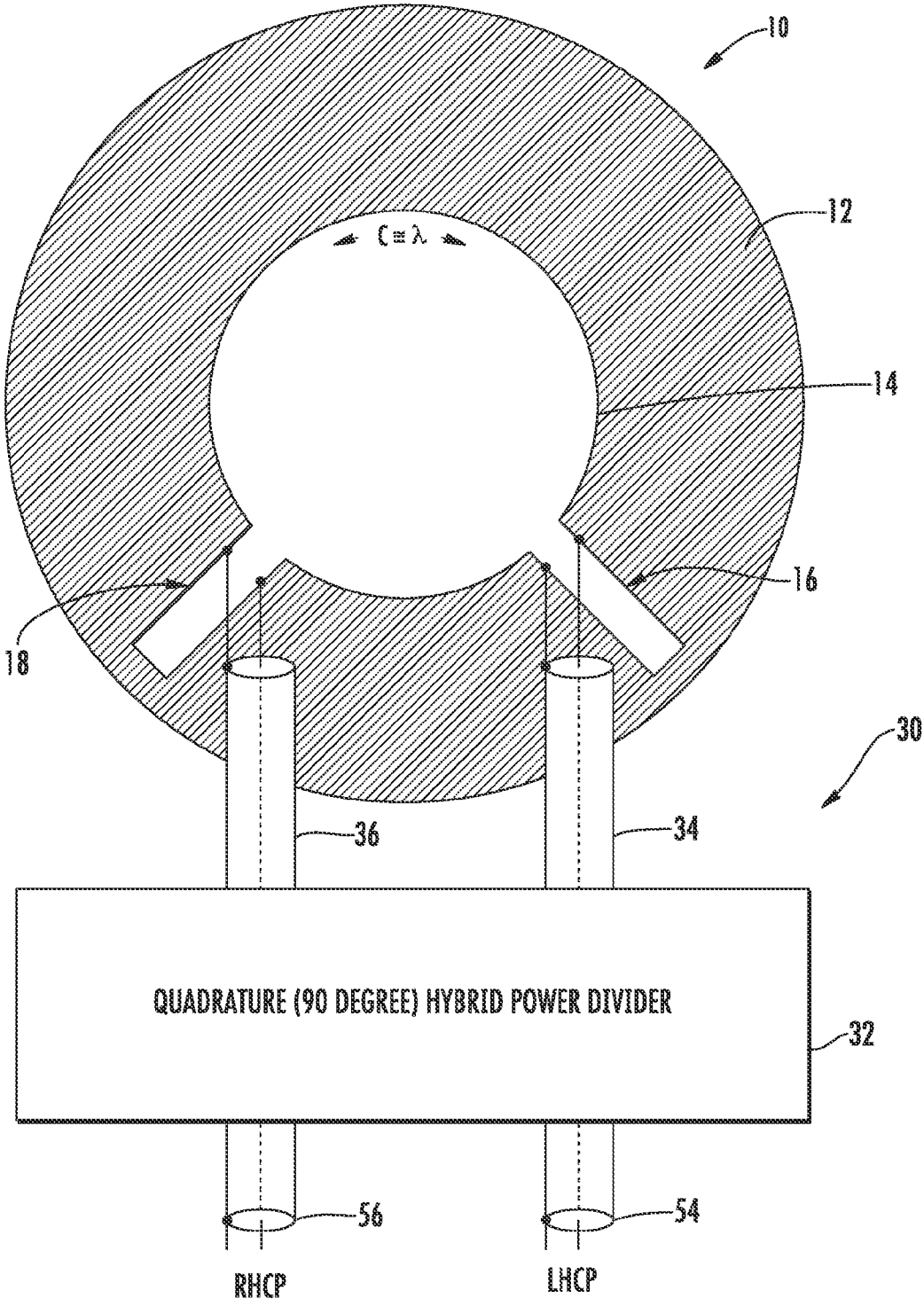
FIG. 3 is a schematic diagram illustrating an embodiment of a planar antenna apparatus including a dual circularly polarized feed structure according to the present invention.

Referring to FIG. 3 another embodiment of the planar antenna apparatus 10 will now be described. The feed structure 30 illustratively includes a quadrature (90-degree) hybrid power divider 32 and associated feed network having, for example, a plurality of coaxial cables 34, 36 connecting the power divider to the signal feedpoints 16, 18. Such a feed structure 30 can drive the slot antenna element 12 of the planar antenna apparatus 10 with the appropriate phase inputs for dual circular polarization, i.e. both right and left hand circular polarization simultaneously as will be appreciated by those skilled in the art. Circularly polarized ports 54, 56 are electrically isolated from one another and they may multiplex different communications on the same frequency, provide simultaneous communications transmission and reception, and provide polarization diversity, etc. (20 to 30 dB of isolation may exist in practice).

Figure 4:
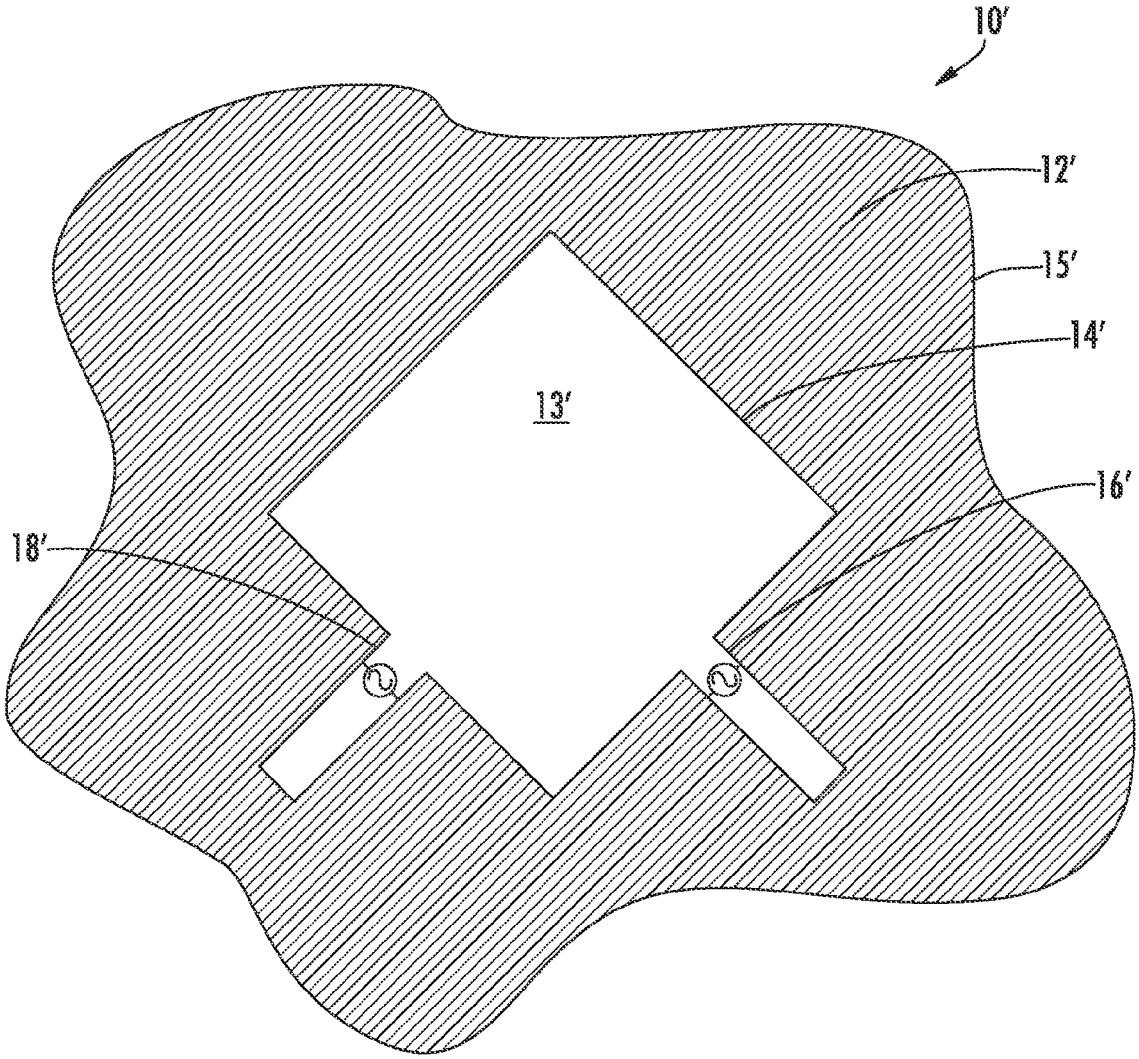
FIG. 4 is a schematic diagram illustrating another embodiment of a planar slot antenna apparatus according to the present invention.

Other feed structures 30 are contemplated for the present invention. For instance, a 0 degree hybrid provides dual linear polarization from the slot antenna element 12, although this may obtained directly from the slot antenna element 12 without a feed structure 30, and a reactive T or Wilkinson type power divider may be used as the feed structure 30 with unequal length cables 34, 36 for single circular polarization. Referring now to FIG. 4, another embodiment of the planar antenna apparatus 10' will be described. Here, the planar, electrically conductive, slot antenna element 12' has an irregular outside shape 15', and a polygonal shaped opening 13', e.g. a square. In the example, since the shape of the opening 13' in the planar, electrically conductive, slot antenna element 12' is a square, and the inner perimeter 14' is equal to about one operating wavelength, then each side is equal to about one quarter of the operating wavelength. Also, the signal feedpoints 16', 18' are separated by a distance of one quarter of the inner perimeter 14' which is about one quarter of the operating wavelength.

Signal feedpoints 16', 18' may be coupled to drive the planar electrically conductive slot antenna element 12' with a phase and amplitude input to provide at least one of linear, circular, dual linear and dual circular polarizations. The planar antenna apparatus 10' approximates the electrical characteristics of planar antenna apparatus 10, e.g. a full wave perimeter polygonal opening 13' is functionally equivalent or nearly so to a full wave circumference circular opening 13, and the irregular outer perimeter 15' provides a useful approximation to the circular outer perimeter 15. While the FIG. 1 embodiment may be optimal for the smallest size, the FIG. 4 embodiment may be more easily fabricated.

Figure 5:
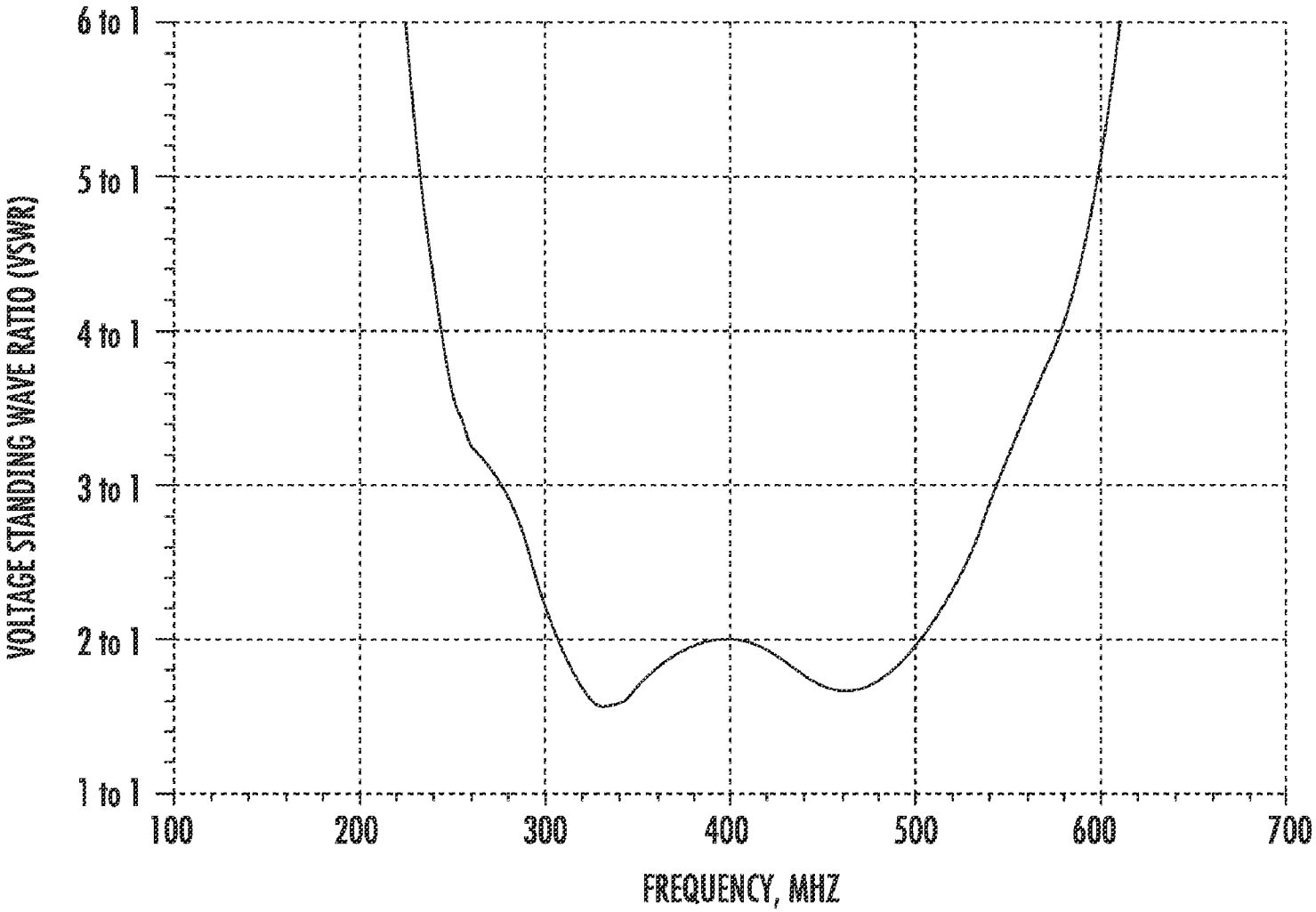
FIG. 5 is a graph illustrating the voltage standing wave ratio (VSWR) response over frequency for the planar slot antenna apparatus of FIG. 3.

FIG. 5 is a graph of the measured VSWR response of the FIG. 1 embodiment of the slot antenna element 12 when operated in a 50 Ohm system. As can be seen, a double tuned (Chebyshev polynomial) type response was provided with a 2:1 VSWR bandwidth of 180 MHz or 45 percent. The conductive plane 40 was a circular disc 1.5 meters in diameter and the geometrically shaped opening 13 was a circle 0.24 meters in diameter. Therefore, the opening 13 was 0.98 wavelengths in circumference at the center (ripple peak) frequency of 390 MHz. In the present invention, coupling and driving resistance is set by the location of the signal feedpoints 16, 18 along the notches 24, 26 (the lowest resistance is obtained near the closed end of the notch). Fine frequency adjustment can be accomplished by increasing or reducing the depth of notches 24, 26. The diameter of the outer perimeter 15 is not as important in the antenna's tuning, relative to the diameter of opening 13.

Figure 6:
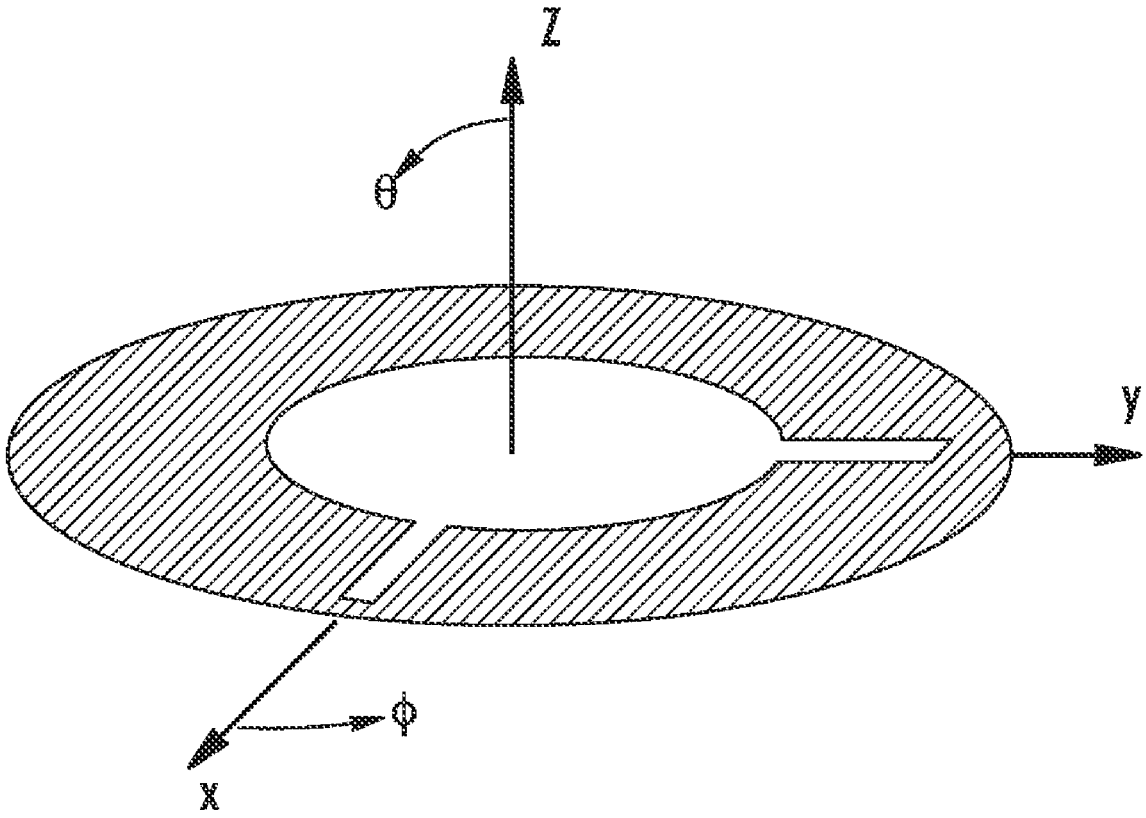
FIG. 6 depicts the planar slot antenna apparatus of the present invention in a standard radiation pattern coordinate system.
Figure 7:
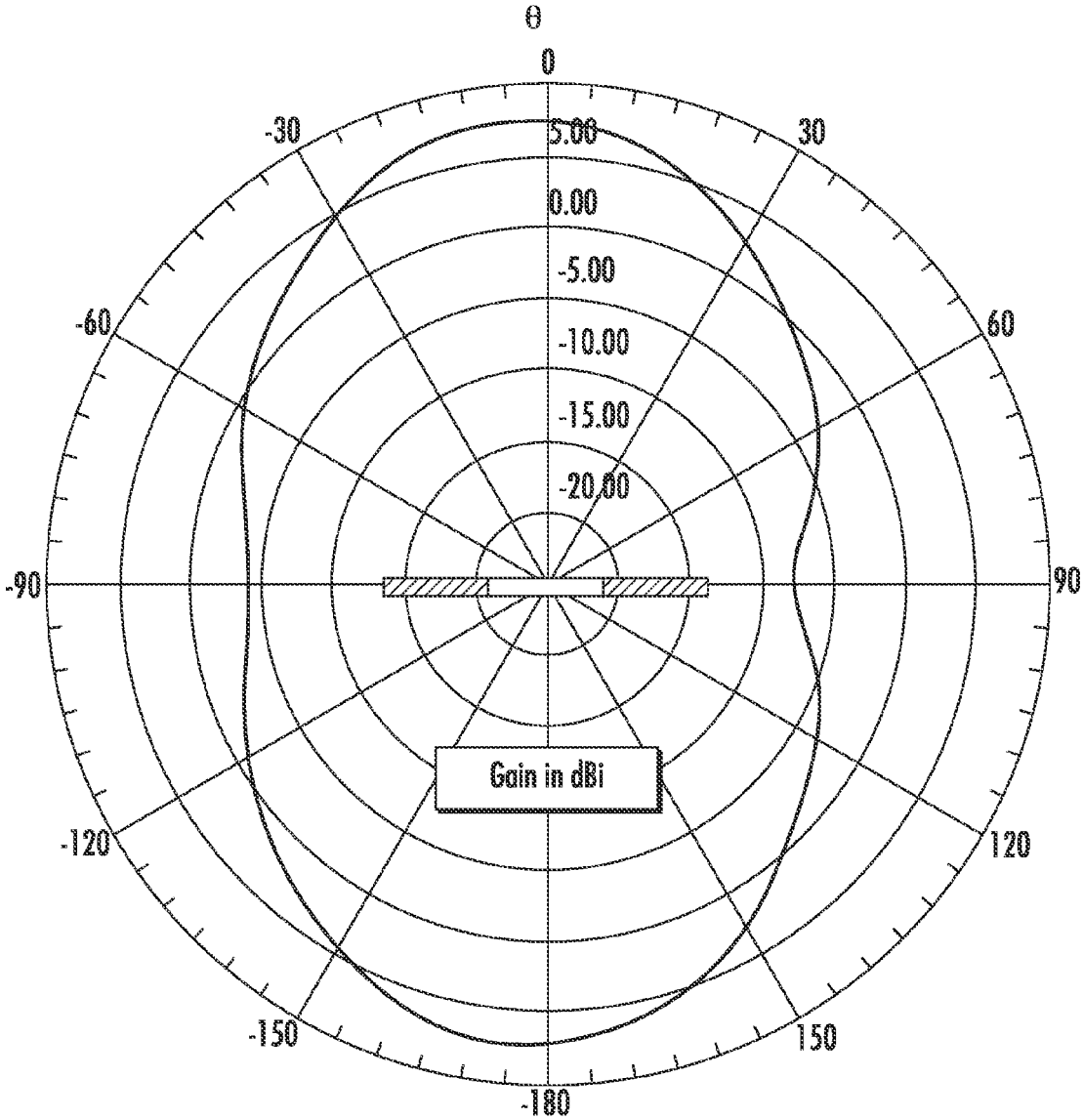
FIG. 7 is a plot of the XZ (elevation plane) far field radiation pattern of the planar slot antenna apparatus of the present invention.

FIG. 6 depicts the planar antenna apparatus in a standard radiation pattern coordinate system. FIG. 7 is a polar plot illustrating the XZ plane elevation cut radiation pattern for the example planar slot antenna apparatus as described in FIG. 1 and without a backing cavity. Total fields are plotted and the units are in dBic or decibels with respect to isotropic, and for circular polarization. The pattern frequency was 390 MHz and the opening 13 was 0.24 meters in diameter.

As can be appreciated, the slot antenna 12 provides a two petal rose (cos$^n$) radiation pattern shape with a pattern maxima (lobes) nearly broadside to the antenna plane, a gain of 7.2 dBic, and a half power beamwidth of 57 degrees. The polarization at the pattern peak was right hand circular with an axial ratio of 0.98. The present invention may of course be operated with a cavity backing to obtain unidirectional radiation, in which case the gain may increase up to 3 dB to near +10.2 dBi. The YZ plane radiation pattern (not shown) was similar to the XZ radiation pattern shown in FIG. 7. The XY azimuth plane radiation pattern (not shown) was approximately circular, linearly polarized, and near −9 dBi in amplitude with shallow minima along the azimuths of the feed notches 24, 26. The radiation patterns were calculated by finite element numerical electromagnetic modeling in the Ansoft High Frequency Structure Simulator (HFSS) code by Ansoft Corporation of Pittsburgh, Pa.

A theory of operation for the planar antenna apparatus 10 follows. The geometrically shaped opening 13 may form a circular aperture or an approximation, to provide a slot compliment full wave loop antenna, as diffraction effect causes RF currents to concentrate near the inner perimeter 14 edges of the conductive plane 40. The current distribution along the edge of the circular aperture may be sinusoidal for linear polarization or traveling wave for circular polarization according to the excitation phases. For instance, for equal amplitude equal phase excitation at signal feedpoints 34, 36, e.g. 1 volt at 0 degrees phase and 1 volt at 0 degrees phase respectively, a standing wave current distribution forms along the inner perimeter 14 with a current maxima half way between signal feedpoints 16, 18. 45° slant linear polarization is radiated and the vertical and horizontal polarization components are referred to signal feedpoints 16, 18 respectively, which is the condition of dual linear polarization.

Continuing the theory of operation, now for circular polarization, phase quadrature excitation (0°, 90°) at signal feedpoints 16, 18 respectively superimposes a sine and cosine current over one another [$\cos\theta=\sin(\theta+90°)$] along inner perimeter 14 resulting in a traveling wave distribution of uniform current amplitude and linear phase advance thereupon, as $\cos^2\theta+\sin^2\theta=1$ and the current is the square of the applied electric potentials at signal feedpoints 16, 18. Signal feedpoints 16, 18 are hybrid and electrically isolated/uncoupled from each other as they are ¼ wavelength separated along a 1 wavelength inner perimeter 14, such that a quadrature hybrid of the branchline coupler type is formed in situ, albeit without the branchlines. Far field radiation is then the Fourier transform of the current distribution, as is common for antennas. As a full wave loop antenna may comprise a circle of thin wire about 1 wavelength in circumference, the present invention can be analyzed as a slot equivalent under Babinet's Principle.

The slot antenna element 12 is not so limited as to require excitation by notches 24, 26. For instance, shunt feeds such as gamma matches may be configured along inner perimeter 14, as may be familiar to those in the art on Yagi Uda antennas. Note that if notches 24, 26 are used for excitation they may be folded for compactness or routed circumferentially.

A method aspect is directed to making a planar antenna apparatus 10 including providing a planar, electrically conductive, slot antenna element 12 having a geometrically shaped opening 13, e.g. a circle or polygon, defining an inner perimeter 14, and forming a pair of spaced apart signal feedpoints 16, 18 along the inner perimeter of the planar, electrically conductive, slot antenna element and separated by a distance of one quarter of the inner perimeter to impart a traveling wave current distribution. The inner perimeter 14 of the planar, electrically conductive, slot antenna element 12 is equal to about one operating wavelength thereof.

The method may include coupling a feed structure 30, 30' to the signal feedpoints 16, 18 to drive the planar, electrically conductive, slot antenna element 12 with a phase input to provide at least one of linear, circular, dual linear and dual circular polarizations.

Thus, the present invention provides a planar antenna with capability for multiple polarizations. It may form an in situ or conformal antenna for aircraft or portable communications. The invention provides more gain than does a slot dipole turnstile and is smaller in area. The VSWR response may include double tuning for the enhancement of bandwidth.

Other features and advantages relating to the embodiments disclosed herein are found in co-pending patent application entitled, PLANAR ANTENNA HAVING MULTI-POLARIZATION CAPABILITY AND ASSOCIATED METHODS, which is being filed on the same date and by the same assignee and inventor, the disclosure of which is hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A planar antenna apparatus comprising:

a planar, electrically conductive, slot antenna element having a geometrically shaped opening therein defining an inner perimeter; and a pair of spaced apart signal feedpoints along the inner perimeter of the planar, electrically conductive, slot antenna element and separated by a distance of one quarter of the inner perimeter to impart a traveling wave current distribution;

the inner perimeter of the planar, electrically conductive, slot antenna element being equal to about one operating wavelength thereof.

2. The planar antenna apparatus according to claim 1, further comprising a feed structure coupled to the signal feedpoints to drive the planar, electrically conductive, slot antenna element with a phase input to provide at least one of linear, circular, dual linear and dual circular polarizations.

3. The planar antenna apparatus according to claim 1, further comprising a 90 degree hybrid feed structure coupled to the signal feedpoints to drive the planar, electrically conductive, slot antenna element with a phase input to provide dual circular polarizations.

4. The planar antenna apparatus according to claim 1, wherein the planar, electrically conductive, slot antenna element is devoid of a ground plane adjacent thereto.

5. The planar antenna apparatus according to claim 1, wherein the geometric shape of the opening of the planar, electrically conductive, slot antenna element comprises a circle.

6. The planar antenna apparatus according to claim 1, wherein the geometric shape of the opening of the planar, electrically conductive, slot antenna element comprises a polygon.

7. The planar antenna apparatus according to claim 1, wherein each of the signal feedpoints defines a discontinuity in the planar, electrically conductive, slot antenna element.

8. The planar antenna apparatus according to claim 7, wherein each of the signal feedpoints comprises a notch in the planar, electrically conductive, slot antenna element.

9. The planar antenna apparatus according to claim 8, wherein each of the notches opens inwardly to the inner perimeter.

10. The planar antenna apparatus according to claim 9, wherein each of the notches extends outwardly from the inner perimeter toward an outer perimeter of the planar, electrically conductive, slot antenna element.

11. The planar antenna apparatus according to claim 9, wherein each of the notches extends outwardly and perpendicular from a respective tangent line of the inner perimeter.

12. A planar antenna apparatus comprising:

a planar, electrically conductive, slot antenna element having a circularly shaped opening therein defining an inner circumference being equal to about one operating wavelength of the planar, electrically conductive, slot antenna element;

a pair of spaced apart signal feedpoints along the inner circumference of the planar, electrically conductive, slot antenna element and separated by a distance of one quarter of the inner circumference; and a feed structure coupled to the signal feedpoints to drive the planar, electrically conductive, slot antenna element with a phase input to provide at least one of linear, circular, dual linear and dual circular polarizations.

13. The planar antenna apparatus according to claim 12, wherein each of the signal feedpoints defines a discontinuity in the planar, electrically conductive, slot antenna element.

14. The planar antenna apparatus according to claim 13, wherein each of the signal feedpoints comprises a notch in the planar, electrically conductive, slot antenna element.

15. The planar antenna apparatus according to claim 14, wherein each of the notches opens inwardly to the inner circumference.

16. The planar antenna apparatus according to claim 15, wherein each of the notches extends outwardly from the inner circumference toward an outer perimeter of the planar, electrically conductive, slot antenna element.

17. The planar antenna apparatus according to claim 15, wherein each of the notches extends outwardly and perpendicular from a respective tangent line of the inner circumference perimeter.

18. A method of making a planar antenna apparatus comprising:

providing a planar, electrically conductive, slot antenna element having a geometrically shaped opening therein defining an inner perimeter; and forming a pair of spaced apart signal feedpoints along the inner perimeter of the planar, electrically conductive, slot antenna element and separated by a distance of one quarter of the inner perimeter to impart a traveling wave current distribution;

the inner perimeter of the planar, electrically conductive, slot antenna element being equal to about one operating wavelength thereof.

19. The method according to claim 18, further comprising coupling a feed structure to the signal feedpoints to drive the planar, electrically conductive, slot antenna element with a phase input to provide at least one of linear, circular, dual linear and dual circular polarizations.

20. The method according to claim 18, wherein the geometric shape of the opening of the planar, electrically conductive, slot antenna element comprises a circle.

21. The method according to claim 18, wherein the geometric shape of the opening of the planar, electrically conductive, slot antenna element comprises a polygon.

22. The method according to claim 18, wherein each of the signal feedpoints defines a discontinuity in the planar, electrically conductive, slot antenna element.

23. The method according to claim 22, wherein forming comprises forming each of the signal feedpoints as a notch in the planar, electrically conductive, slot antenna element.

24. The method according to claim 23, wherein each of the notches opens inwardly to the inner perimeter.

25. The method according to claim 24, wherein each of the notches extends outwardly from the inner perimeter toward an outer perimeter of the planar, electrically conductive, slot antenna element.

* * * * *